US008910942B2

(12) United States Patent
Cohen et al.

(10) Patent No.: US 8,910,942 B2
(45) Date of Patent: Dec. 16, 2014

(54) PUZZLE

(71) Applicants: Avraham Cohen, Great Neck, NY (US); Dean Gah, Ramat Gan (IL)

(72) Inventors: Avraham Cohen, Great Neck, NY (US); Dean Gah, Ramat Gan (IL)

( * ) Notice: Subject to any disclaimer, the term of this patent is extended or adjusted under 35 U.S.C. 154(b) by 0 days.

(21) Appl. No.: 13/680,718

(22) Filed: Nov. 19, 2012

(65) Prior Publication Data

US 2014/0138910 A1 May 22, 2014

(51) Int. Cl.
*A63F 9/10* (2006.01)

(52) U.S. Cl.
CPC ..... *A63F 9/10* (2013.01)
USPC ..... 273/157 R

(58) Field of Classification Search
USPC ..... 273/157 R; D21/478–480
See application file for complete search history.

(56) References Cited

U.S. PATENT DOCUMENTS

| | | | | | |
|---|---|---|---|---|---|
| 928,540 | A * | 7/1909 | Rawitch | 273/157 R |
| 1,230,263 | A * | 6/1917 | Alexander | 273/157 R |
| 1,676,641 | A * | 7/1928 | Eschenbach | 273/157 R |
| 2,923,551 | A * | 2/1960 | Pope | 273/157 R |
| 2,953,380 | A * | 9/1960 | Hassenbach | 273/157 R |
| 3,302,310 | A * | 2/1967 | Leven | 273/156 |
| 4,830,376 | A * | 5/1989 | Hillis | 273/157 R |
| 5,351,957 | A * | 10/1994 | Scott | 273/157 R |
| 5,368,301 | A * | 11/1994 | Mitchell | 273/157 R |
| 5,439,221 | A * | 8/1995 | Harvie | 273/157 R |
| 5,813,154 | A * | 9/1998 | Wilford | 273/157 R |
| 7,510,187 | B2 * | 3/2009 | Haag | 273/157 R |
| 7,789,392 | B2 * | 9/2010 | Kishon | 273/157 R |

* cited by examiner

*Primary Examiner* — Steven Wong

(57) ABSTRACT

A puzzle having a plurality of puzzle pieces configured to be assembled into a plurality of different coherent images.

8 Claims, 10 Drawing Sheets

Fig. 3A
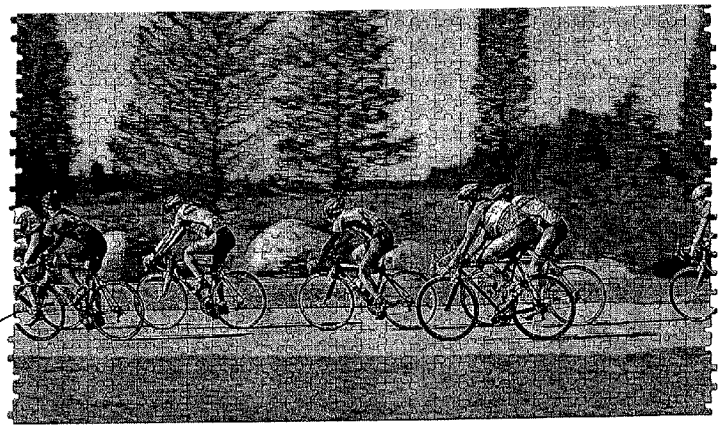
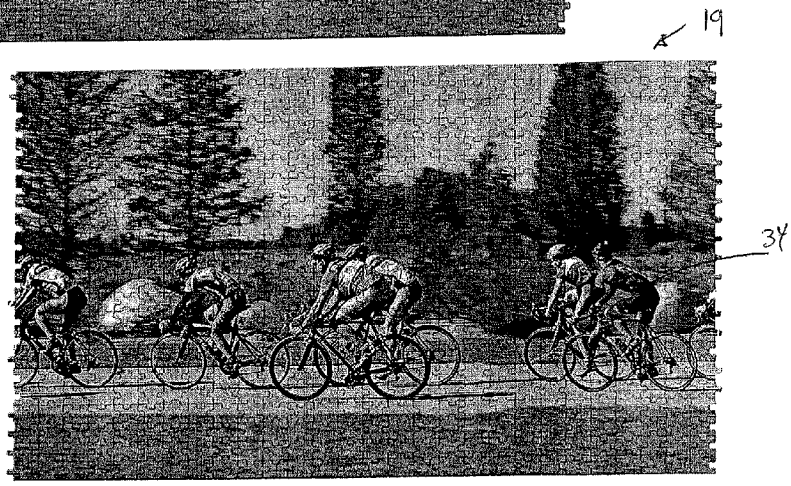
Fig. 3B

PUZZLE

FIELD OF THE INVENTION

The present invention relates to games and the like amusement devices, and in particular to a puzzle arrangement having a plurality of puzzle pieces configured for assembly into a plurality of different images.

BACKGROUND AND SUMMARY OF THE INVENTION

Puzzles are well known. A conventional puzzle includes a plurality of puzzle pieces, which can mate to realize a single coherent image. Each puzzle piece in such a configuration is cut so that it can reside at one and only one unique position within the puzzle relative to the other pieces in the puzzle. Thus, the puzzle pieces cannot be reassembled to realize a different coherent image.

A puzzle according to the present invention includes a plurality of puzzle pieces that can be rearranged and assembled to realize a plurality of different coherent images. Thus, each puzzle piece in a puzzle according to the present invention is configured to be positioned in more than one unique place within the puzzle relative to the other puzzle pieces allowing the user to assemble the puzzle pieces into different coherent images.

Other features and advantages of the present invention will become apparent from the following description of the invention which refers to the accompanying drawings.

BRIEF DESCRIPTION OF THE DRAWINGS

FIG. 3A depicts another example of a puzzle according to the present invention assembled to exhibit one coherent image.

FIG. 3B depicts another example of the puzzle shown in FIG. 3A reassembled to exhibit another coherent image.

DETAILED DESCRIPTION OF EMBODIMENTS OF THE INVENTION

Image or coherent image as used herein refers to a visually perceptible representation or likeness of an object, an animal, a human being, a fictional character, a cartoon character, a non-fictional character or person, a landscape, a cityscape, an event, a scenery or the like and excluding any image resulting from the random assembly of puzzle pieces resulting in an incomprehensible visual image having no corresponding example in physical reality.

Figure 1:
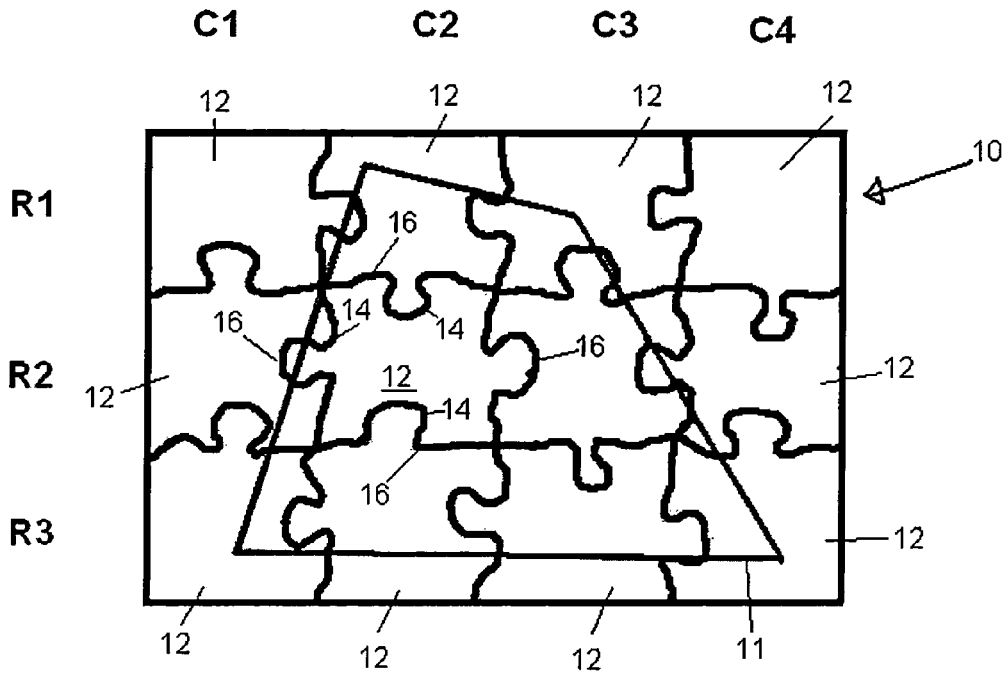
Fig. 1 Prior Art
FIG. 1 depicts a top plan view of a puzzle according to the prior art in an assembled state.

FIG. 1 is a top plan view of a conventional and well known puzzle arrangement 10, which includes a plurality of puzzle pieces 12 arranged in a unique puzzle array to realize an image 11, for example, an irregular trapezoid against a plain background, as illustrated.

Each puzzle piece 12 in a conventional puzzle 10 includes at least a portion of the image that is realized once the puzzle is assembled, and is configured to occupy a unique place within the puzzle array relative to other puzzle pieces when the puzzle is fully assembled.

Specifically, puzzle 10 is configured so that each puzzle piece 12 occupies a unique column and row position within the puzzle array. In the puzzle shown in FIG. 1, there are four column positions (identified with C1, C2, C3, C4) and three row positions (identified with R1, R2, R3). If the left-most column of puzzle pieces 12 is considered the first column position and the top-most row of puzzle pieces is considered the first row position then puzzle piece 12' would occupy the unique address of second column and second row within the array of puzzle pieces 12, the array of puzzle pieces including puzzle piece 12'.

Puzzle piece 12' in this conventional configuration could not occupy any other position within the array of puzzle pieces, whereby another coherent image would be obtained. That is, puzzle piece 12 would always have to be at column 2 (C2), row 2 (R2) position to obtain a coherent image. The same restriction applies to the other puzzle pieces 12. That is, all pieces would have a unique address (column, row) within the puzzle array.

In a conventional puzzle, each puzzle piece includes a peripheral edge configured so that it may mate (i.e. couple) with a unique group of other puzzle pieces 12 in the array of puzzle pieces. To be more specific, the peripheral edge of each puzzle piece 12 is cut to have a plurality of sections 14 each section 14 being cut to have a shape complementary to a corresponding, unique section 16 of the peripheral edge of another puzzle piece, whereby the two uniquely complementarily-shaped sections 14,16 can mate with one another. Thus, puzzle piece 12' would have a peripheral edge having a section 14 that mates with a section 16 of a puzzle piece at column 1, row 2; a section 14 that mates with a section 16 of a puzzle piece 12 at column 2, row 1; a section 14 that mates with a section 16 of a puzzle piece at column 2, row 3; and a section 14 that mates with a section 16 of a puzzle piece at column 3, row 2. In a conventional puzzle, upon final assembly, a panel is realized having straight, boundaries. The puzzle pieces 12 residing at the boundaries (e.g. puzzle piece at C4, R2 location) have at least one section which is rendered incapable of interlocking with another puzzle piece 12. Thus, only one completely assembled panel with interlocked puzzle pieces 12 exhibiting a coherent image is possible with a conventional puzzle. Consequently, a user can assemble a puzzle 10 only in one way and thus can obtain only one coherent image once puzzle pieces 12 are assembled because each puzzle piece can only have one puzzle array address (i.e. a location defined by a column position and a row position) and because the puzzle pieces 12 are configured to be assembled into one puzzle panel only.

A puzzle according to the present invention is configured so that a user may assemble the puzzle, with the same puzzle pieces, to attain at least two fully assembled (i.e. all pieces interlocking to realize a single panel) puzzles each with a different, coherent image.

In a puzzle according to the present invention, a puzzle piece can reside at more than one unique location within the puzzle array. Thus, the puzzle pieces are not restricted to unique array addresses. Rather, each puzzle piece can have at least two array addresses allowing the user to assemble the same puzzle pieces into different images.

Figure 2A:
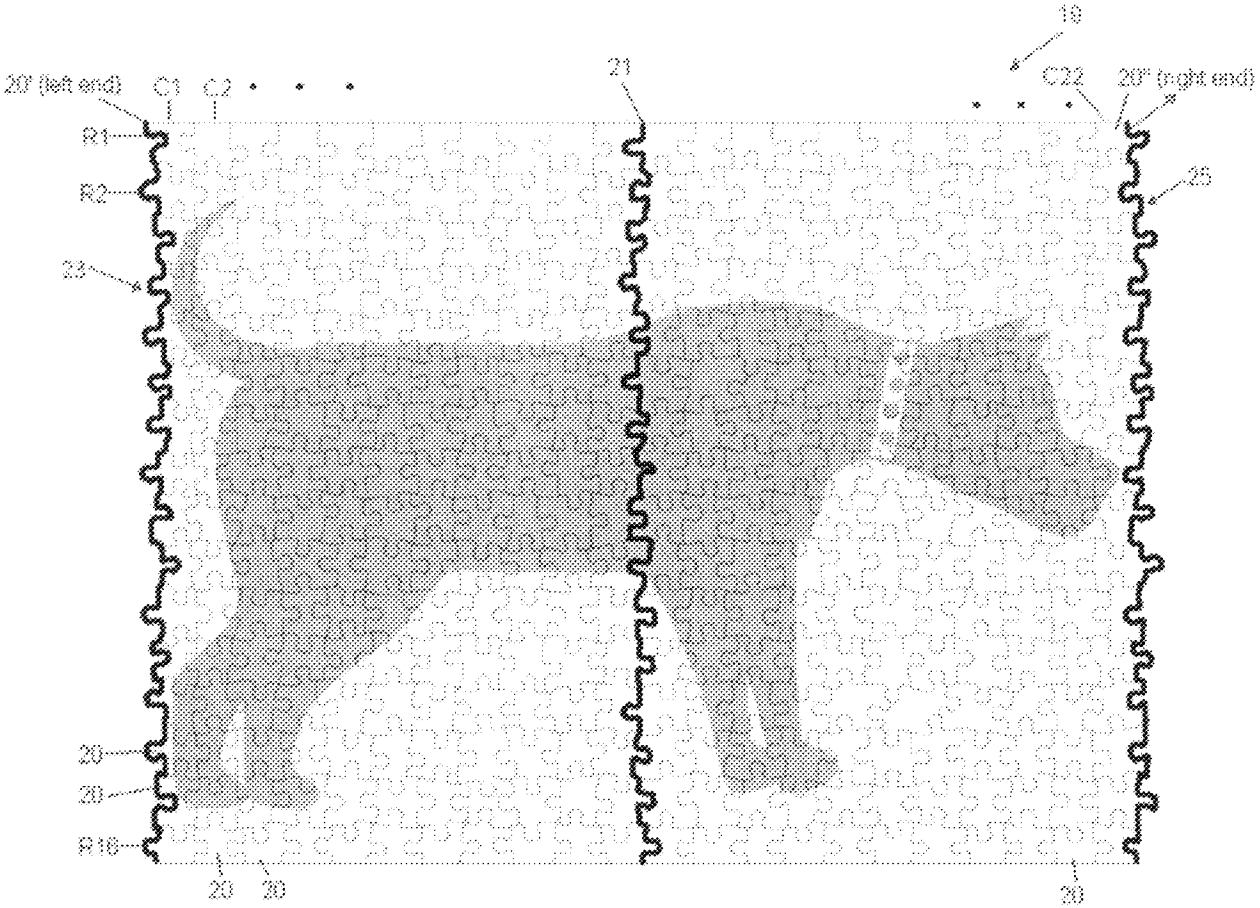
FIG. 2A depicts a top plan view of a puzzle according to one embodiment of the present invention assembled to realize one coherent image, namely, an image of a dog.
Figure 2B:
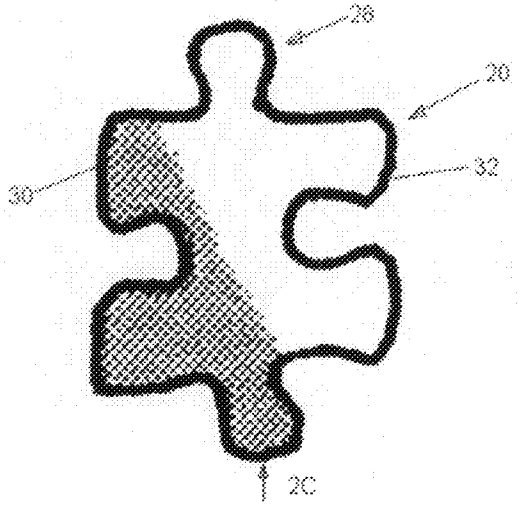
FIG. 2B depicts a top plan view of a puzzle piece from the embodiment shown in FIG. 2A, the puzzle piece being identified in FIG. 2D with identifier 2B.
Figure 2C:
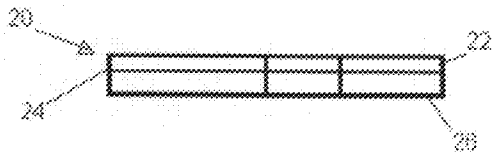
FIG. 2C depicts a side plan view of the puzzle piece shown in FIG. 2B viewed in the direction of arrow 2C in FIG. 2B.
Figure 2D:
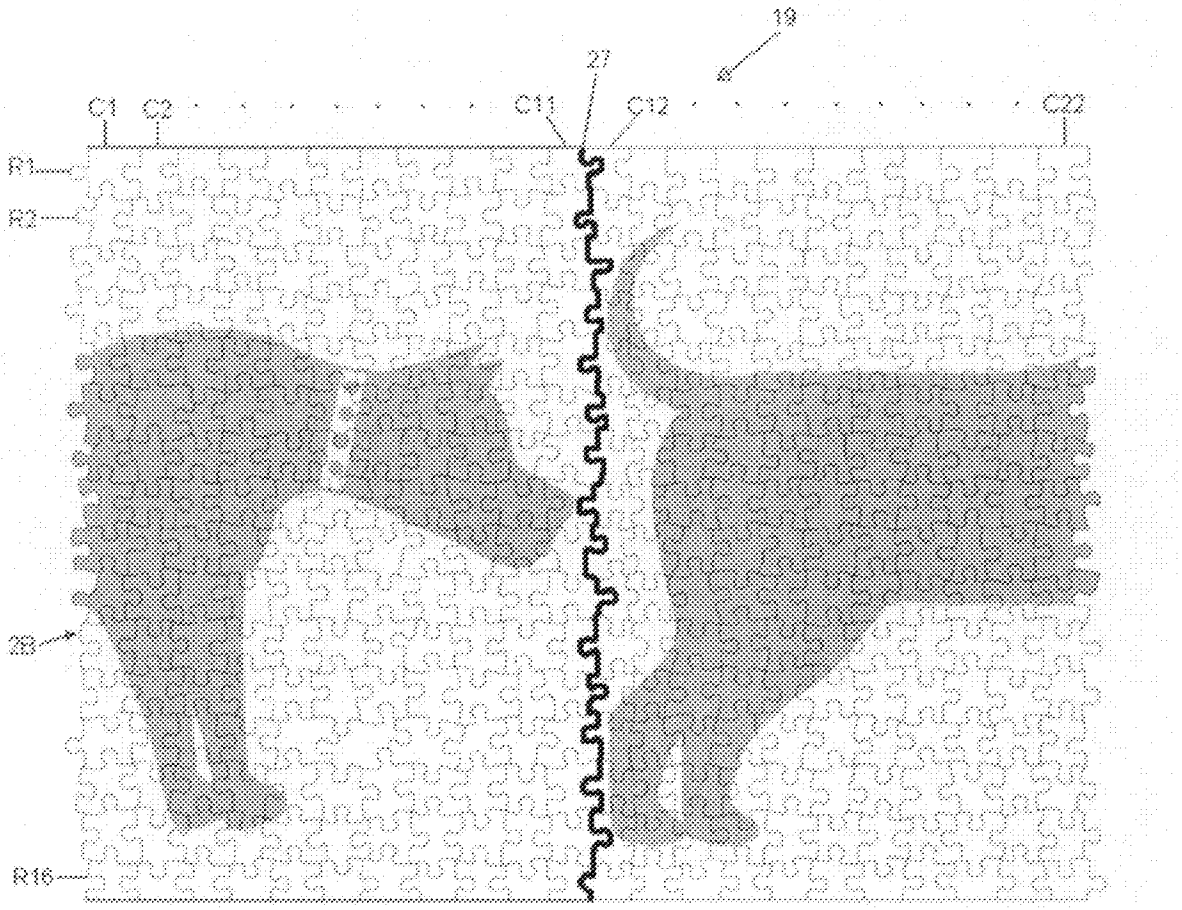
FIG. 2D depicts a top plan view of a puzzle according to one embodiment of the present invention assembled to realize another coherent image, namely, an image of a dog following another dog.

A comparison of FIGS. 2A and 2D would serve as a good illustration of the advantages of a puzzle arrangement according to the present invention. FIG. 2A illustrates an image of a dog attained by assembling puzzle pieces 20 into a panel of interlocked puzzle pieces 20. Referring to FIG. 2D, the same puzzle pieces 20 are reassembled into another panel of interlocked puzzle pieces 20 to attain a different image, namely the partial images of two dogs, creating the impression of two dogs following one another.

The image shown in FIG. 2D is attained by disassembling the puzzle of FIG. 2A along a first assembly joint 21 resulting from the mating (i.e. interlocking) of puzzle pieces 20, and reassembling the puzzle by mating the left-most vertical cut line 23 with the right-most vertical cut line 25, thereby obtaining a second assembly joint 27 resulting from the mating, i.e. interlocking of puzzle pieces 20 having edges at lines 23 and 25 (cut lines and the assembly joints being rendered bold for illustration and would not be necessarily provided in a puzzle according to the present invention). Thus, a puzzle according to the present invention includes at least two assembly joints 21, 27 along which two halves of the puzzle can mate to obtain two different coherent images.

Referring to FIGS. 2B and 2C, each puzzle piece 20 is preferably a flat (i.e. a planar) body made with cardboard or the like and having a sheet of paper 22 or the like on the front surface 24 thereof bearing a portion of an image. Front surface 24 is opposite to back surface 26 and both surfaces 24, 26 are bound by, and meet at an endless, continuous peripheral edge 28. Front and back surfaces 24,26 are preferably planar and parallel to one another.

Peripheral edge 28 of each puzzle piece includes at least two sections 30, 32, disposed opposite one another, that are cut to mate with a corresponding section 30, 32 of a peripheral edge 28 of two other puzzle pieces 20. Thus, section 30 of one puzzle piece 20 can mate with section 32 of a puzzle piece 20 and section 32 can mate with section 30 of another puzzle piece 20.

Mate and all its grammatical variations as used herein indicate that a section 30 of one puzzle piece 20 has a shape complementary to a section 32 of another puzzle piece 20 so that the two sections meet one another and make contact with one another to realize a gapless joint and to attain a part of the final image that is to be realized upon complete assembly of the puzzle pieces.

In the preferred embodiment, puzzle pieces 20 are configured to be arranged along rows and columns as illustrated in FIG. 2A. The row positions and the column positions define a puzzle array. Each row position and column position combination defines an address within the array. According to the present invention, each address within the puzzle array is not associated with a unique puzzle piece 20 (unlike the prior art) but may be occupied by more than one puzzle piece 20 and still allow the user to assemble a coherent image with the puzzle pieces 20, unlike a prior art puzzle in which the misplacement of a puzzle piece can result in the disruption of the final image.

To illustrate, the example shown in FIGS. 2A and 2D is a puzzle having a puzzle array that is defined by 22 column positions (C1, C2 . . . C22) and 16 row positions (R1, R2 . . . R16). For the sake of simplicity, the left-most column may be designated column 1 and the right-most column may be designated column 22, while the top row may be designated row 1 and the bottom row may be row 16. Columns between column 1 and column 22 may be consecutively numbered, and rows between row 1 and row 16 may be consecutively numbered thus allowing for 22×16 (352) addresses, which, unlike the prior art, can be occupied by more than one puzzle piece 20.

In this embodiment, each puzzle piece 20 is configured to be situated in a unique row within the puzzle array defined by column and row positions, but is not restricted to be situated in only one column position. Thus, a puzzle piece 20 may be moved within the same row to a different column position but not to a different row position. To realize such a configuration, each puzzle piece 20 in column 1 (C1) in FIG. 2A is configured to have a section 30 that mates with a section 32 of another puzzle piece 20 in column (C22) of the assembled panel shown in FIG. 2A. Consequently, all puzzle pieces 20 in columns 1 and 22 (C1, and C22) mate to realize another assembled panel with a different image (i.e. the image shown in FIG. 2D). Thus, puzzle pieces 20, while remaining in the same row positions, will end up in different column positions. For example, puzzle pieces 20 in column 1 of FIG. 2A will occupy column 12 (C12) and puzzle pieces 20 in column 22 (C22) of FIG. 2A will occupy column 11 (C11) in the image shown in FIG. 2D.

In this embodiment, sections 30, 32 are lateral sections of peripheral edge 28 of each puzzle piece 20 meaning the right and left edges. Thus, a puzzle piece 20 can be moved within its designated row position to another column position. However, in this embodiment, top and bottom edges, which extend between sections 30,32, are cut to mate with unique puzzle pieces 20. That is, in this embodiment, the puzzle pieces 20, will be configured to reside at a unique row address but not a unique column address within the puzzle array. Thus, the position of each puzzle piece 20 within a column of puzzle pieces is fixed.

FIGS. 3A and 3B illustrate a more dramatic result. Thus, as shown in FIG. 3A, in one assembly rider 34 is seen to be ahead relative to some riders. After a reassembly, as shown in FIG. 3B, rider 34 is seen to be behind those riders.

Figure 4A:
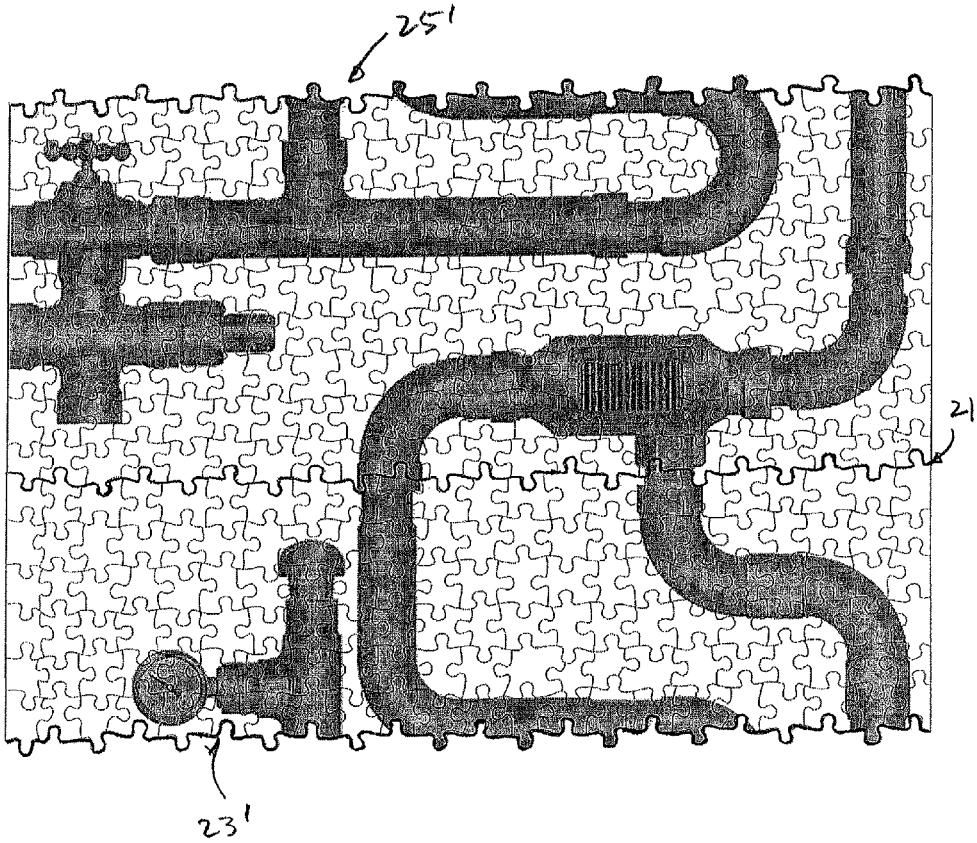
FIGS. 4A and 4B illustrate a puzzle according to a second embodiment of the invention.
Figure 4B:
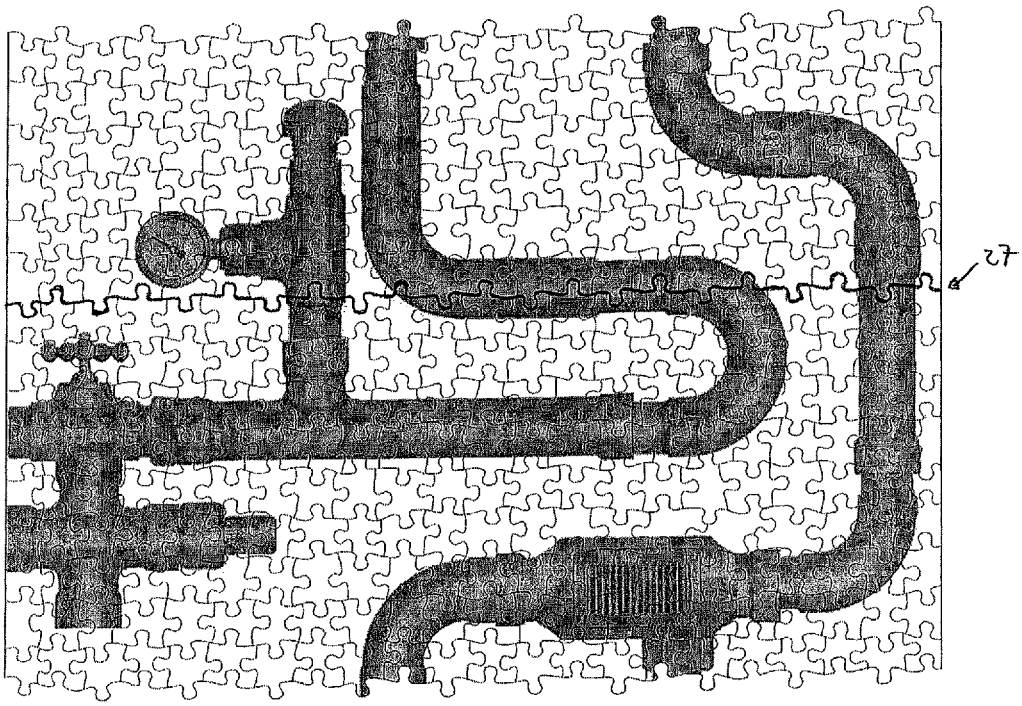

It should be understood that while in the preferred embodiment, the left-most and right-most edges of each puzzle are configured for mating to allow for assembly of two panels each exhibiting a different coherent image, a skilled person would understand that puzzle pieces could be configured (i.e. cut) to be restricted within a given column but not restricted to the same row by configuring the top and bottom edges of each puzzle to mate to allow for two assembly joints. For example, the puzzle assembly could be simply turned so that the left and right edges would become top and bottom edges. For example, as shown in FIG. 4A, first assembly joint 21 (horizontally oriented) is disposed between bottom-most horizontal line 23' and top-most horizontal line 25'. FIG. 4B shows the second assembly joint 27 resulting from the mating of lines 23' and 25'. In this embodiment, puzzle pieces at lines 23' and 25' can occupy more than one row position within a puzzle array having the same configuration (i.e., column and row addressing) as the one in the first embodiment. In this embodiment, however, the column positions of the puzzle pieces at lines 23' and 25' does not vary.

Figure 5A:
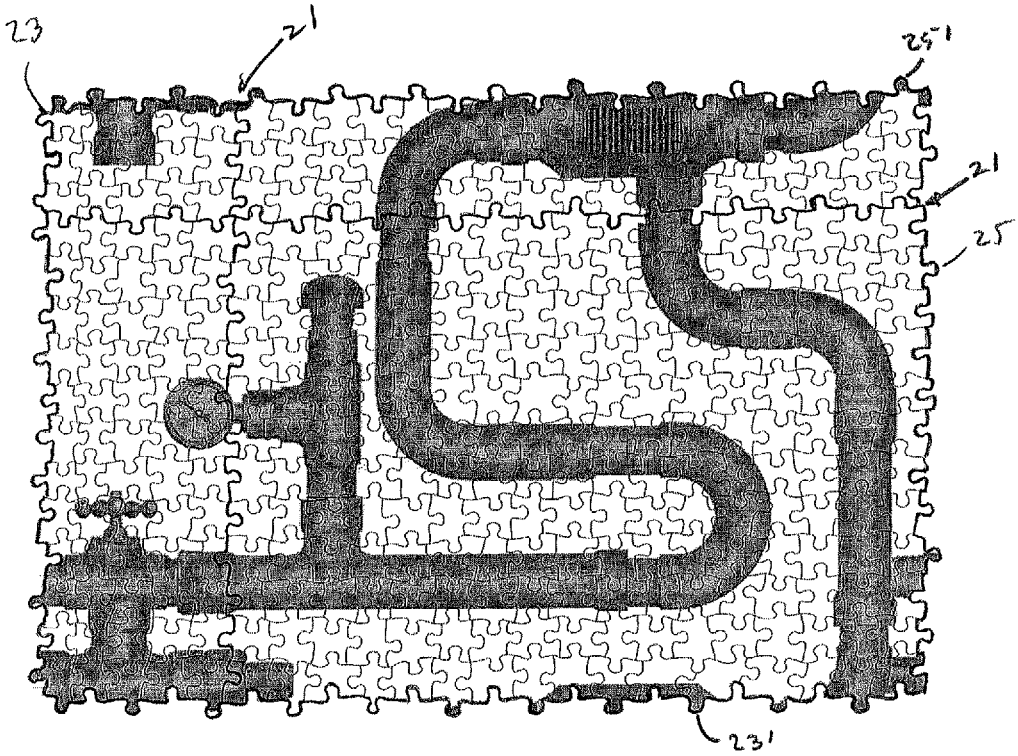
FIGS. 5A-5C illustrate a puzzle according to a third embodiment of the invention.
Figure 5B:
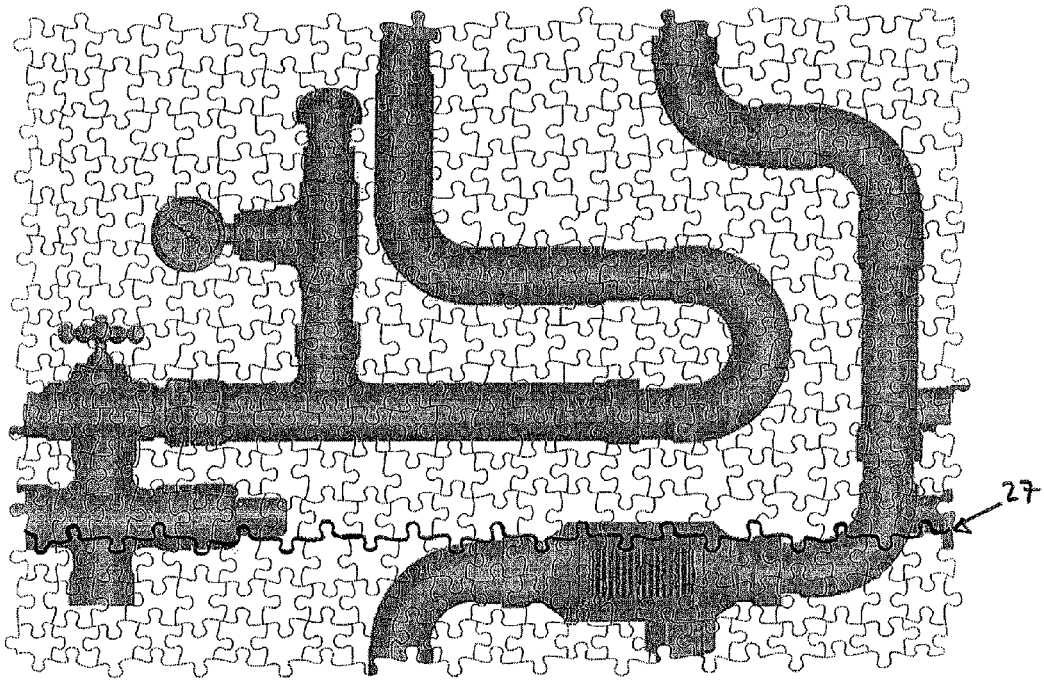
Figure 5C:
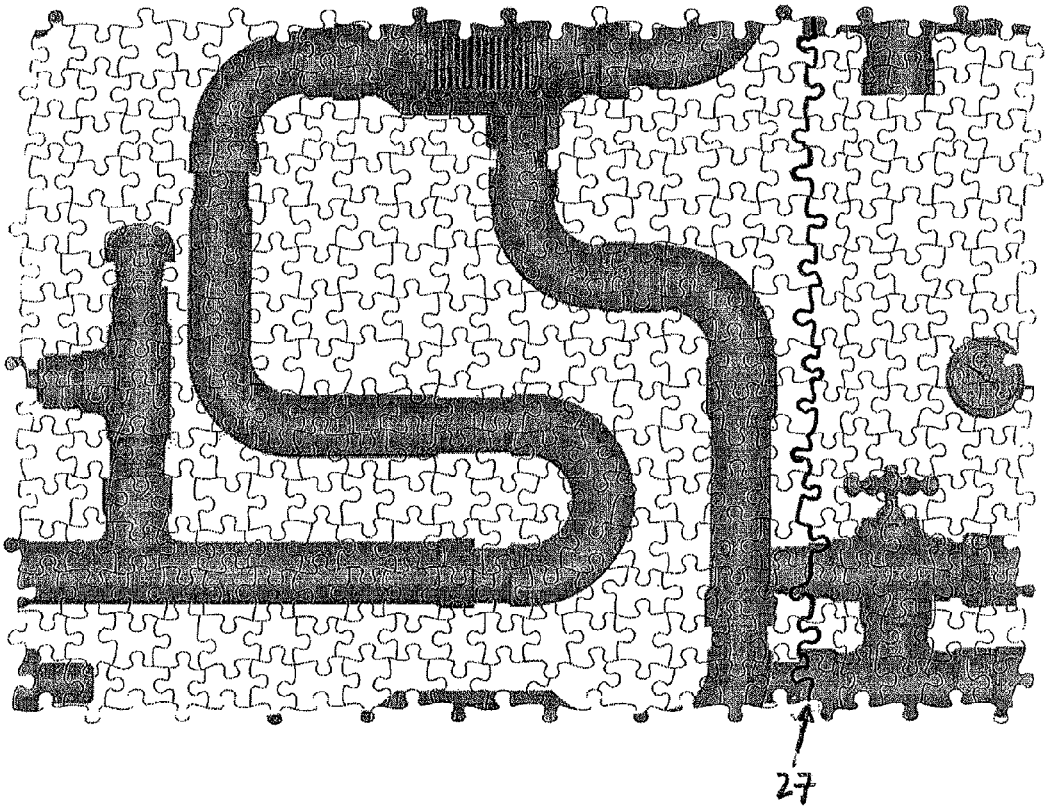

Also, it should be noted that while a puzzle according to the present invention as shown and described herein includes two assembly joints allowing for assembly of two fully assembled panels exhibiting an image different from the other, it should be noted that more than two assembly joints may be provided to allow for assembly of more than two panels. An example of a puzzle having vertically oriented first and second joints 21, 27 and horizontally oriented first and second joints 21, 27 is illustrated in FIGS. 5A-5C. A puzzle as illustrated in FIGS. 5A-5C includes puzzle pieces that can occupy more than one address within a puzzle arrayed as described in detail above. In this configuration, puzzle pieces residing at vertically oriented joints can occupy more than one column position within the puzzle array and puzzle pieces residing at the horizontally oriented joints can occupy more than one row position within the puzzle array.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A puzzle that includes a plurality of puzzle pieces configured to be assembled to obtain a plurality of different coherent images by placement of said puzzle pieces in a puzzle array defined by column positions and row positions, wherein each said puzzle piece in said plurality of puzzle pieces can occupy more than one array address defined by a column position and a row position; wherein each puzzle piece is defined by a front surface, a back surface opposite to said front surface, said front and said back surfaces being bound by and meeting at an endless, continuous peripheral edge, wherein each puzzle piece in said plurality of puzzle pieces that is configured to occupy more than one address within said puzzle array has a peripheral edge that is unique, wherein each puzzle piece is comprised of a planar body having a portion of an image from said plurality of coherent images on at least one surface thereof.

2. A puzzle according to claim 1, wherein each said puzzle piece include a peripheral edge having a plurality of sections, at least two of said sections being configured to mate with a section of a peripheral edge of two other puzzle pieces.

3. A puzzle piece according to claim 2, wherein each puzzle piece includes a portion of an image from said plurality of different coherent images.

4. A puzzle according to claim 1, wherein each puzzle piece includes a peripheral edge having at least a left edge section and a right edge section, wherein said left edge section of each puzzle piece is configured to mate with a right edge section of another puzzle piece, and said right edge section of each puzzle piece is configured to mate with a left edge section of another puzzle piece.

5. A puzzle that includes a plurality of puzzle pieces configured to be assembled to obtain a plurality of different coherent images by placement of said puzzle pieces in a puzzle array defined by column positions and row positions, wherein each said puzzle piece in said plurality of puzzle pieces can occupy more than one array address defined by a column position and a row position; wherein each puzzle piece is defined by a front surface, a back surface opposite to said front surface, said front and said back surfaces being bound by and meeting at an endless, continuous peripheral edge, wherein at least a first group of said puzzle pieces includes first puzzle pieces each with a unique peripheral edge and a second group of puzzle pieces includes second puzzle pieces each with a unique peripheral edge, wherein said first puzzle pieces mate with one another and said second puzzle pieces mate with one another when said puzzle is presented in a first coherent image and a second coherent image from among said plurality of different coherent images, and wherein said puzzle is configured so that said first group of puzzle pieces mate with said second group of puzzle pieces at a joint when said puzzle is assembled to present said first coherent image from among said plurality of different coherent images and said puzzle is configured to be assembled to present said second coherent image from said plurality of different coherent images with said first group of puzzle pieces and said second group of puzzle pieces in an un-mated state, wherein each puzzle piece is comprised of a planar body having a portion of an image from said plurality of coherent images on at least one surface thereof.

6. A puzzle according to claim 5, wherein each puzzle piece in said first and said second group of puzzle pieces is configured to reside at an address within an array having a row position selected from more than one row position within said puzzle array, and a unique column position.

7. A puzzle according to claim 1, wherein said puzzle pieces may be assembled along at least two assembly joints to realize at least two different assembled panels, each panel exhibiting an image different from an image exhibited by the other panel.

8. A puzzle according to claim 5, wherein each puzzle piece in said first and said second group of puzzle pieces is configured to reside at an address within an array having a column position selected from more than one column position within said puzzle array, and a unique row position.

* * * * *